US009975021B1

(12) United States Patent
Sokolik

(10) Patent No.: US 9,975,021 B1
(45) Date of Patent: May 22, 2018

(54) BALL RETRIEVING RECEPTACLE

(71) Applicant: Michael J. Sokolik, Mount Prospect, IL (US)

(72) Inventor: Michael J. Sokolik, Mount Prospect, IL (US)

( * ) Notice: Subject to any disclaimer, the term of this patent is extended or adjusted under 35 U.S.C. 154(b) by 0 days. days.

(21) Appl. No.: 15/800,029

(22) Filed: Oct. 31, 2017

(51) Int. Cl.
*A63B 47/02* (2006.01)
*A63B 59/20* (2015.01)
*A63B 65/12* (2006.01)
*A63B 102/18* (2015.01)

(52) U.S. Cl.
CPC ..... *A63B 59/20* (2015.10); *A63B 47/02* (2013.01); *A63B 65/122* (2013.01); *A63B 2102/18* (2015.10)

(58) Field of Classification Search
CPC ..... A63B 59/20; A63B 47/02; A63B 65/122
USPC ..... 294/19.2; 473/286, 517, 457, 553
See application file for complete search history.

(56) References Cited

U.S. PATENT DOCUMENTS 2,523,942 A * 9/1950 Ciambriello ..... A63B 47/02 294/19.2
2,623,749 A * 12/1952 Kummer ..... A63D 15/003 273/123 R
2,721,682 A * 10/1955 Lefebvre ..... A63B 55/20 294/166
3,170,688 A * 2/1965 Porter ..... A63B 59/20 2/19
4,302,017 A * 11/1981 Huqueriza ..... A63B 59/20 473/510
4,482,019 A * 11/1984 Murphy ..... E01H 1/042 171/130
4,863,174 A 9/1989 Cummings
5,190,288 A * 3/1993 Rogers ..... A63B 47/02 294/19.2
5,437,488 A 8/1995 Richmond
5,899,511 A * 5/1999 Dinatale ..... A63B 47/02 294/19.2
7,357,739 B2 4/2008 Montano
D630,277 S 1/2011 McKinnell
D634,489 S 3/2011 Page
D637,248 S 5/2011 Levin
8,418,681 B2 4/2013 Levin
9,392,768 B1 7/2016 Mullin
9,623,304 B2 4/2017 Clarke
9,630,076 B2 4/2017 Evans
2002/0078533 A1 6/2002 Strebl
2008/0261714 A1* 10/2008 Bae ..... A63B 47/02 473/286

(Continued)

*Primary Examiner* — Paul T Chin
(74) *Attorney, Agent, or Firm* — Chicago IP Law; Steven M. Evans

(57) ABSTRACT

A ball retrieving receptacle that attaches to the ball-striking area of a bat. The receptacle comprises a tubular sleeve having a diameter sized to fit tightly or securely around a ball-striking surface of a bat. The tubular sleeve includes a top opening and a bottom opening, and a sloping collar connected to the tubular sleeve. A semisphere hood is connected to the outer rim of the sloping collar, and the semisphere hood includes a semicircle rim extending in front of an opening of the semisphere hood and is connected to the outer rim of the sloping collar. The ball retrieving receptacle is attached to a bat having a handle and a ball-striking surface, wherein ball-striking surface of the bat is located tightly against the tubular sleeve of the ball retrieving receptacle.

18 Claims, 12 Drawing Sheets

(56) References Cited

U.S. PATENT DOCUMENTS

| | | | | |
|---|---|---|---|---|
| 2013/0167818 | A1* | 7/2013 | Ivanic | A63B 65/122<br>124/5 |
| 2015/0018129 | A1* | 1/2015 | Van Alen | A63B 67/02<br>473/409 |

* cited by examiner

BALL RETRIEVING RECEPTACLE

BACKGROUND OF THE INVENTION

Field of the Invention

The present invention relates generally to sports equipment, and more particularly, to a portable baseball or softball retrieving receptacle.

Description of Related Art

The vast majority of baseball and softball coaches typically bend over incorrectly to pick up a baseball or softball during practice or pre-game workouts. Over time, this repeated incorrect bending can be a direct cause of chronic back pain and joint pain, such as knees, legs, and hips. Coaches in the MLB (Major League Baseball) are one of the oldest groups in professional sports. As a result, many MLB coaches limit themselves to the amount of time they can physically withstand staying around the game.

Accordingly, there is a need for a device that would reduce the amount of bending over to pickup baseballs or softballs during practice.

ASPECTS AND SUMMARY OF THE PRESENT INVENTION

One aspect of the present invention is to provide a device that would reduce the amount of bending over to pickup baseballs or softballs during practice.

Another aspect of the present invention is to provide a portable device that can be easily transported and installed to assist in reducing or eliminating the bending over movements to pick up baseballs or softballs, such as during fielding practice by coaches and assistants, in order to reduce back injuries and chronic back pain and or joint pain.

A further aspect of the present invention is to provide a low cost ball retriever that can be easily used and installed on existing baseball equipment.

Another aspect of the present invention is to provide a simple and durable piece of baseball equipment that will last for many years without breaking.

In order to provide these aspects and others, the present invention provides a small and portable ball retrieving receptacle for a bat, such as a baseball or softball bat, that attaches to the end of the ball striking area of the bat, opposite the handle end. The ball retrieving receptacle comprises a tubular sleeve having a diameter sized to fit tightly or securely around a ball-striking surface of a baseball or softball bat. The tubular sleeve preferably is rigid and includes a top opening and a bottom opening, and a circular wall extending in between, wherein the top opening has a greater diameter than the bottom opening, and the diameter of the circular wall decreases as the circular wall extends from the top opening to the bottom opening. A sloping collar has a bottom connected to the top opening of the tubular sleeve, and the diameter of the sloping collar increases as the sloping collar extends away from the top opening toward an outer rim of the sloping collar. A semisphere hood, preferably rigid, is connected to the outer rim of the sloping collar, and the semisphere hood includes a semicircle rim extending in front of an opening of the semisphere hood and is connected to the outer rim of the sloping collar. The baseball retrieving receptacle is attached to a baseball bat having a handle and a ball-striking surface, wherein ball-striking surface of the baseball bat is located tightly within the tubular sleeve of the ball retrieving receptacle.

The ball retrieving receptacle, or The Kup™ as the present invention or product is called by the inventor, enables baseball and softball coaches and assistants to avoid having to repeatedly bend over to pick of baseballs or softballs, such as during fielding practice when the coach or assistance is using a bat to hit balls to players. The receptacle also enables older coaches and assistants to continue coaching baseball teams by reducing the strain on their backs, joints, and lower lumbar by reducing the bending over movements during practice. The Kup™ also allows the coach to work solo with his or her team. Typical practice or pregame workout involves two coaches; one to hit the ball and one to soft toss the ball to the coach hitting fielding practice. The Kup™ eliminates that second coach soft tossing the ball to the hitting coach. The hitting coach can simply use The Kup™ to retrieve the ball themselves.

The receptacle not only reduces the strain and strenuous bending on backs, but the receptacle also provides tremendous convenience for the coaches by eliminating the need to bend over to pick up the baseball or softball when the coach is hitting fielding practice to the team. The receptacle also provides a convenient way of shagging balls. The receptacle further provides an innovative way for coaches to project a "ground ball" or "pop fly" for team practice, without actually taking the ball off or out of the receptacle. In one motion the coach can pick up the ball and sling either a "ground ball" or "pop fly", based on a swing motion. Once a ball is secure within the receptacle, the coach has the option to grab the ball with his or her hand and hit an ordinary infield or outfield practice hit to their players, or simply secure the ball within the receptacle and take a normal bat swing with the direction of up or down depending on whether a user's intention is a ground ball or a pop fly.

To utilize the present invention, the receptacle preferably is attached to the end of the ball striking area of a bat, such as a baseball or softball bat, by securing the tubular sleeve of the receptacle around the end of the ball-striking area of the bat. Once the ball is secure within the receptacle, a coach can sling a baseball towards his players during fielding practice using a normal bat swing. The quick change in bat head direction during the swing and a sudden decrease in bat speed allows the ball to eject from the receptacle. In order to attach the receptacle to the bat, simply feed the bat handle (smallest diameter of the bat) through the top opening or mouth of the receptacle until the receptacle reaches the end of the ball striking area of the bat. The tapered geometry at the end of the ball striking area of the bat prevents the receptacle from coming off the ball striking end of the bat. Accordingly, the receptacle can only be removed at the handle end of the bat for safety reasons.

Other embodiments enable the ball retrieving receptacle to attach to a bat by different designs. For example, the opening or neck of ball retrieving receptacle can be over the barrel or ball striking surface of the bat and is secured in position using snaps or other fasteners to secure in place. The receptacle can also be a press fit, strap/clamp fit, screw fit, or snap fit. The Kup™, as the ball retrieving receptacle is referred to by the inventor, can also be made of a rubber material. In this case you could slip the Kup™ on from starting with the end of the bat, and roll the neck down the bat, similar to how a condom functions. There can be other variations of the Kup™, for different sizes and shapes of different types of bats. The Kup™ also can function by itself; meaning a person can use as an individual product with just their hand.

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed invention and specific embodiments as a basis for designing or modifying other structures for carrying out the same purposes of the present invention, and that such other structures do not depart from the spirit and scope of the invention in its broadest form.

BRIEF DESCRIPTION OF THE DRAWINGS

FIG. 1*a* is a side view of a conventional bat;

DETAILED DESCRIPTION OF THE PREFERRED EMBODIMENT

Figure 1:
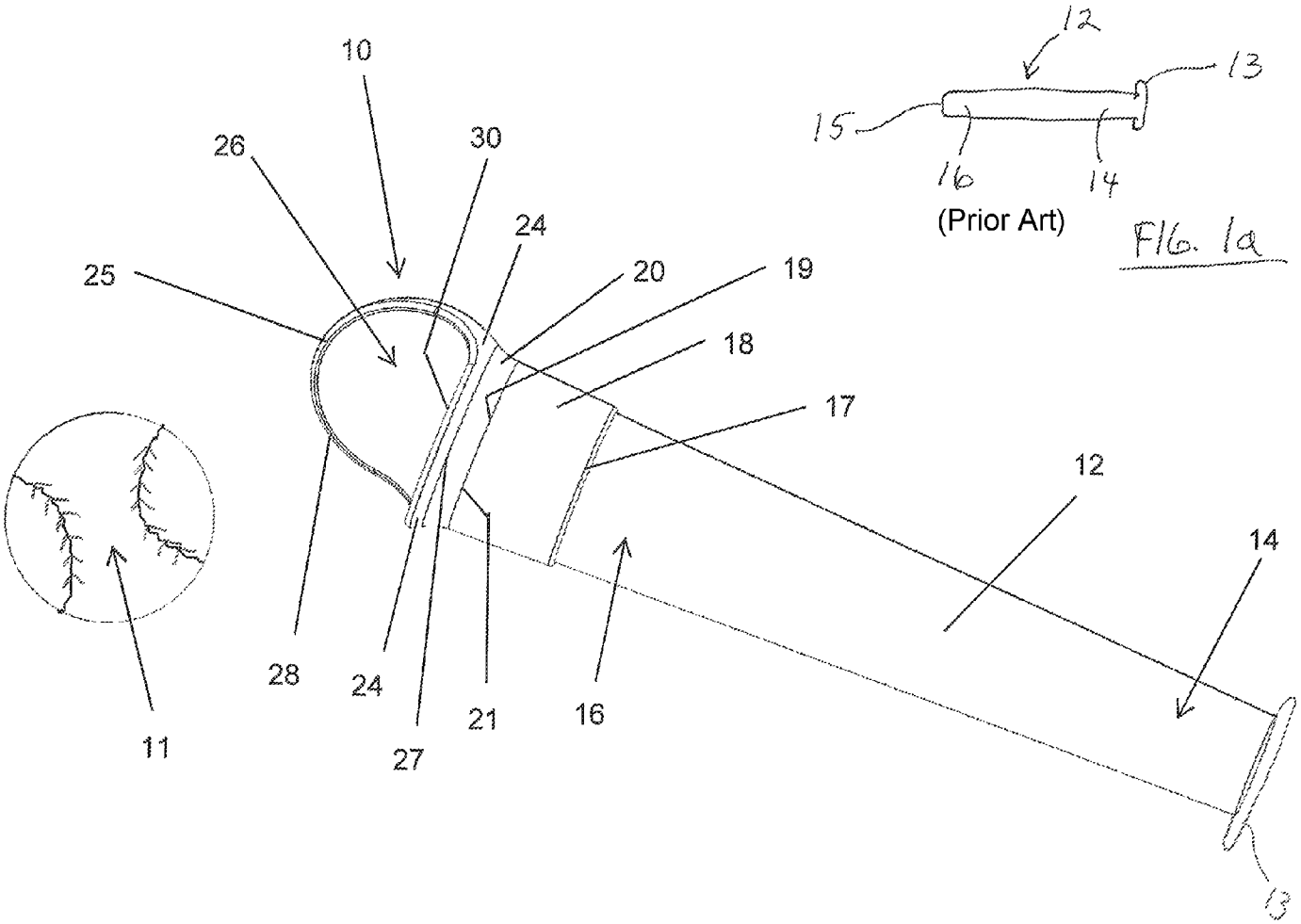
FIG. 1 is a perspective view of a ball retrieving receptacle configured in accordance with the present invention attached to a bat and a corresponding ball to be retrieved by the receptacle.

Referring now to the drawings, FIG. 1 is a perspective view of a ball retrieval receptacle 10 configured in accordance with the present invention. The ball retrieval receptacle 10 is attached to the conventional bat 12 in accordance with the present invention. The ball retrieving receptacle 10 is sized to receive a different sized bat or having different configurations, such as a baseball or softball bat.

As shown in FIGS. 1 and 1*a*, the bat 12 has a handle area 14 and a ball-striking surface or ball-striking area 16. The diameter of the handle or handle area 14 has a smaller diameter than the ball-striking area 16, and the diameter of the bat 12 increases from smaller diameter at the handle area 14 to larger diameter at the ball-striking area 16. The end 13 of the handle 14 is shown in FIG. 1*a*, as well as the end 15 of the ball striking surface 16.

The ball retrieving receptacle 10 includes a tubular sleeve 18 having a bottom opening 17 and a top end or top opening 19. The tubular sleeve 18 is preferably constructed of a rigid material, such a thick plastic or metal. The tubular sleeve 18 can be constructed of a more flexible material, such as a flexible polymer or rubber. The tubular sleeve 18 has a diameter sized to correspond to the diameter and shape of the striking-area 16 of the bat 12. The tubular sleeve 18 can be sized to correspond to a baseball bat or a softball bat, including both wooden bats and aluminum bats. The diameter of the tubular sleeve 18 preferably increases from the bottom opening 17 to the top opening 19, similar to the increasing diameter of the bat 12 between the handle area 14 and the ball-striking area 16. When the ball retrieving receptacle 10 is properly connected to a bat 12, the ball retrieving receptacle 10 fits tightly or snuggly around the ball-striking area 16 adjacent to the end 15 of the bat 12, and the receptacle 10 cannot slide off the end 15 of the ball striking area 16.

A sloping collar 20 having a bottom 21 is connected to the top opening 19 of the tubular sleeve 18. The diameter of the sloping collar 20 increases from the bottom 21 to the top 22 (FIG. 2) to form the sloping collar 20 having a wide lip opening 22. The sloping collar 20 also preferably is constructed of rigid material, such as think plastic, but also can be constructed of a more flexible material, such as a polymer or rubber.

A semisphere hood 24 having a top 25 and a bottom 27 is connected to the top opening 22 (FIG. 2) of the sloping collar 20. The hood 24 preferably forms a rigid semisphere 28 sized for receiving a corresponding baseball or softball 11. An opening 26 of the hood or pulpit 24 receives the ball 11. The hood 24 includes a semicircle rim 30 that extends in front of the opening 26 of the hood 24. The bottom 27 of the hood 24 includes the bottom 27 of the semicircle rim 30 which is connected to the top opening 22 of the sloping collar 20. Similar to the sleeve 18 and the sloping collar 20, the hood 24 preferably is constructed of a rigid material, such a thick plastic, but can be constructed of a more flexible material, such as a polymer or rubber. Preferably, the sleeve 18, sloping collar 20, and hood 24 are constructed is a single unit molded from the same material, such a molded plastic.

Figure 2:
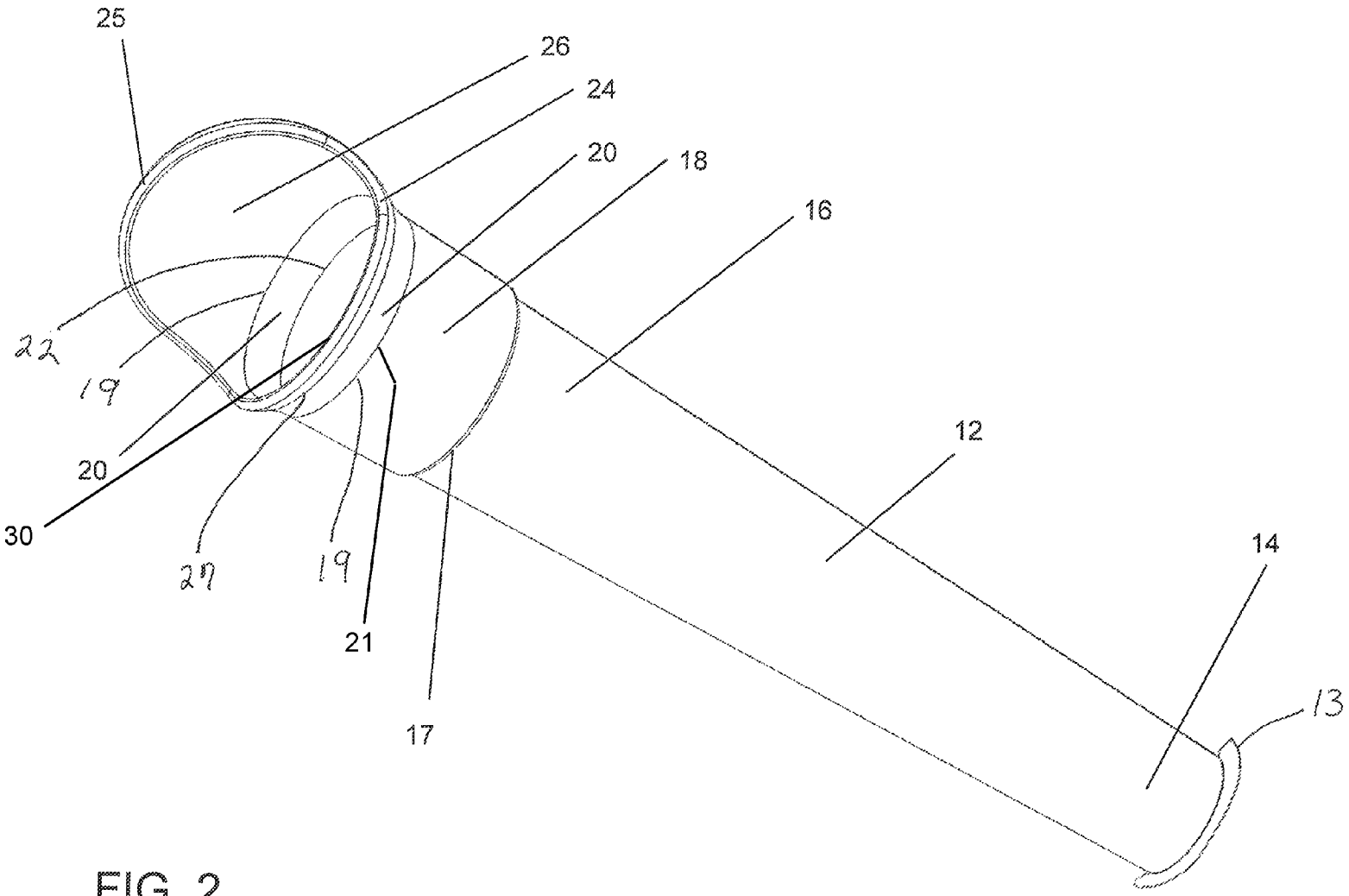
FIG. 2 is an enlarged perspective view of the ball retrieving receptacle and bat shown in FIG. 1.

FIG. 2 is a perspective view of the ball retrieving receptacle 10 connected to the bat 12 shown in FIG. 1 from a different angle. The handle area 14 and the ball-striking surface 16 of the bat 12 are illustrated. Also shown are the sleeve 18 and the hood 24. The bottom opening 17 and the top opening 19 of the sleeve 18 are further illustrated. The top opening 19 of the sleeve 18 and the top 22 and bottom 21 of the sloping collar 20 can be seen inside the opening 26 of the hood 24. The semicircle 30 and top 25 of the hood 24 also is further illustrated.

Figure 3:
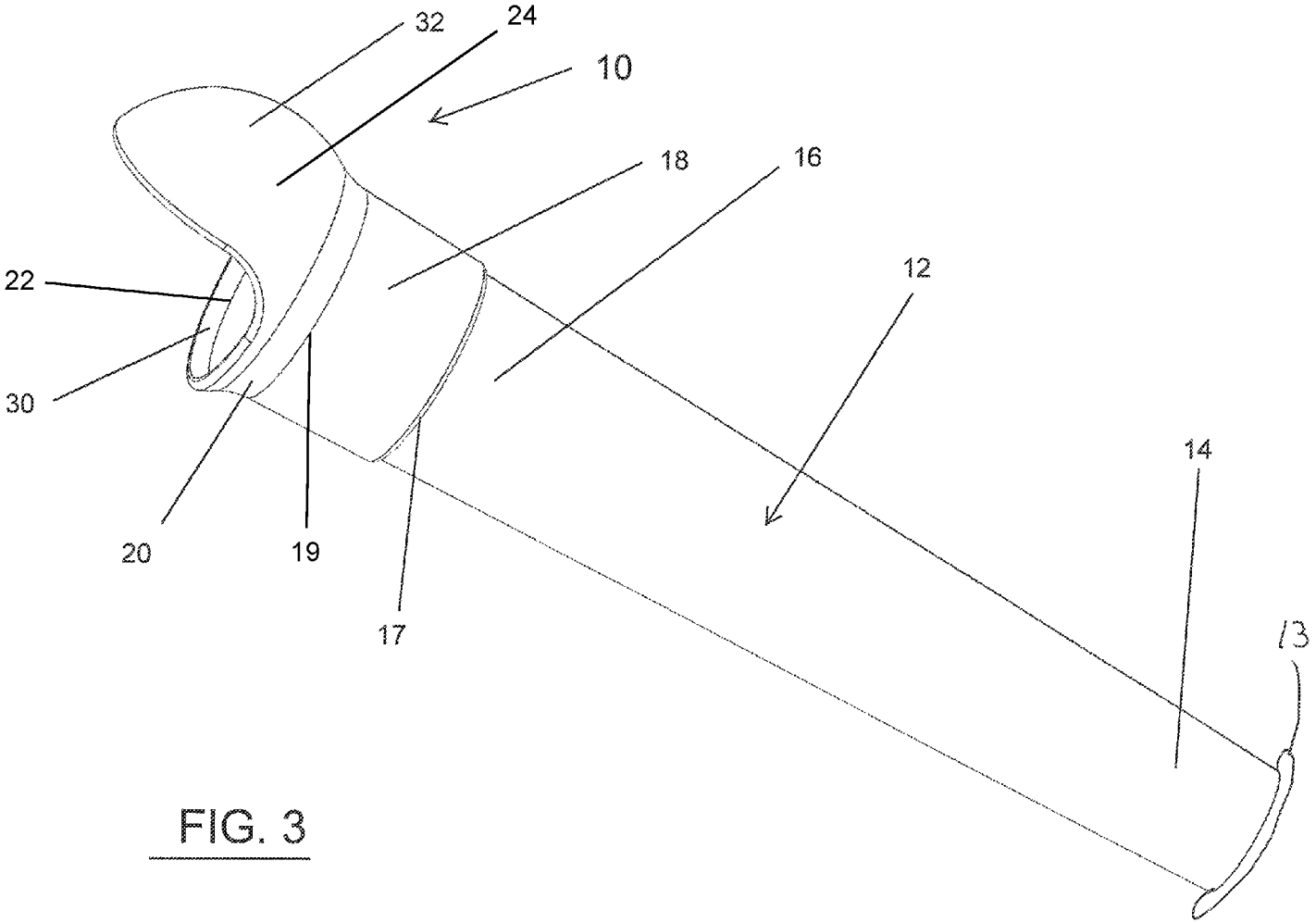
FIG. 3 is a perspective view of the ball retrieving receptacle and bat shown in FIGS. 1 and 2 from a different angle.

FIG. 3 is a perspective view of the ball retrieving receptacle 10 connected to the bat 12 shown in FIGS. 1 and 2 from a different angle. The back 32 of the hood 24 can be more easily viewed in FIG. 3. Also further illustrated are the semicircle rim 30 and top opening 22 of the sloping collar 20 from inside the opening 26 of the hood 24. The top opening 19 and bottom opening 17 of the sleeve 18 also is illustrated.

Figure 4:
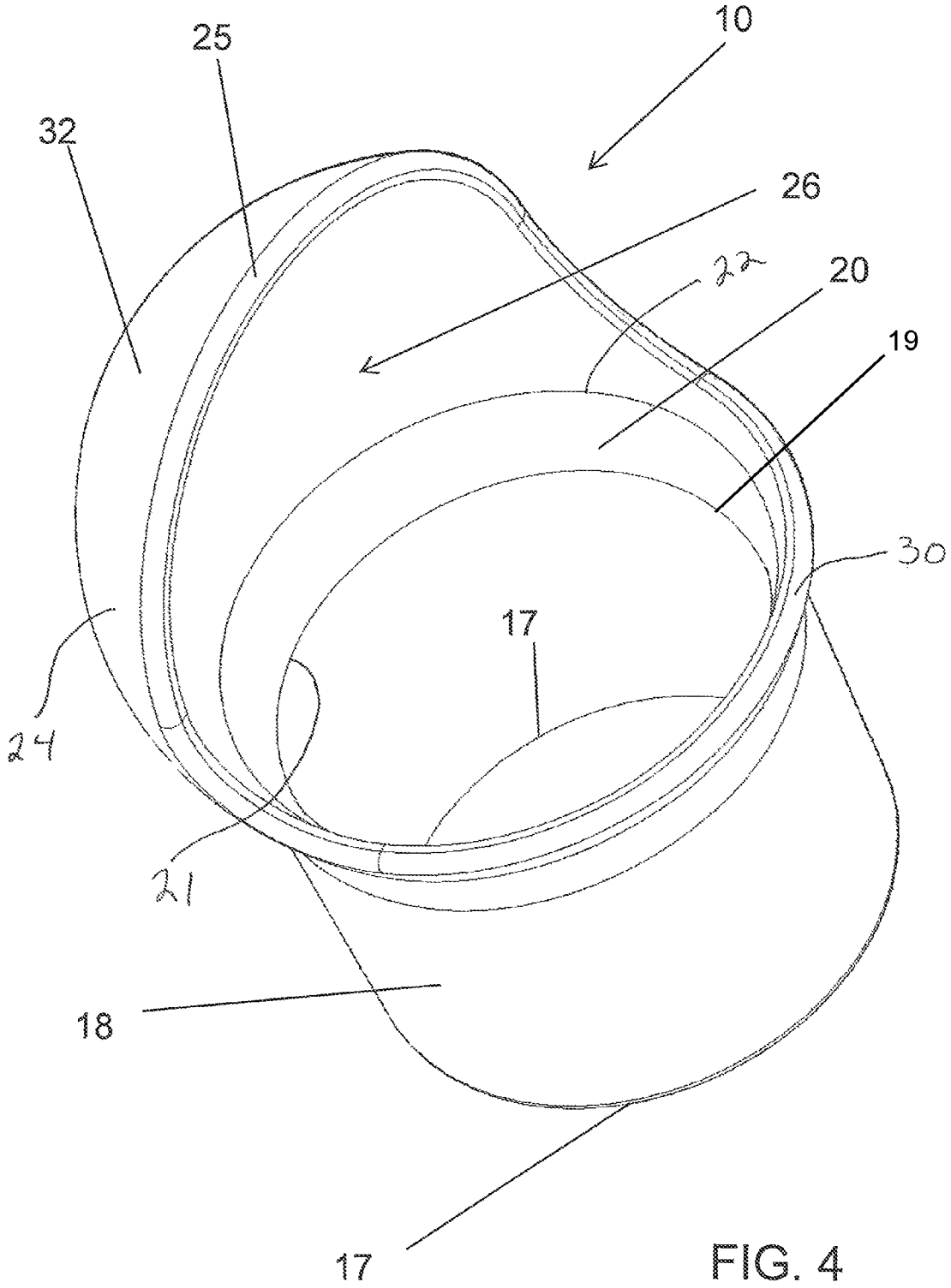
FIG. 4 is a perspective view of the ball retrieving receptacle shown in FIGS. 1-3 and separated from the bat.

FIG. 4 is a perspective view of the ball retrieving receptacle 10 separated and apart from the bat 12. FIG. 4 also illustrates the ball retrieving receptacle 10 from a different perspective. The opening 26 of the hood 24 and inside the hood 24 is more clearly illustrated in FIG. 4. An inner view of the sleeve 18, the sloping collar 20, and the semicircle ring 30 of the ball receiving receptacle 10 also is illustrated. Further illustrated are the bottom opening 17 and top opening 19 of the tubular sleeve 18. The top 22 and bottom 21 of the sloping collar 20 also are shown.

Figure 5:
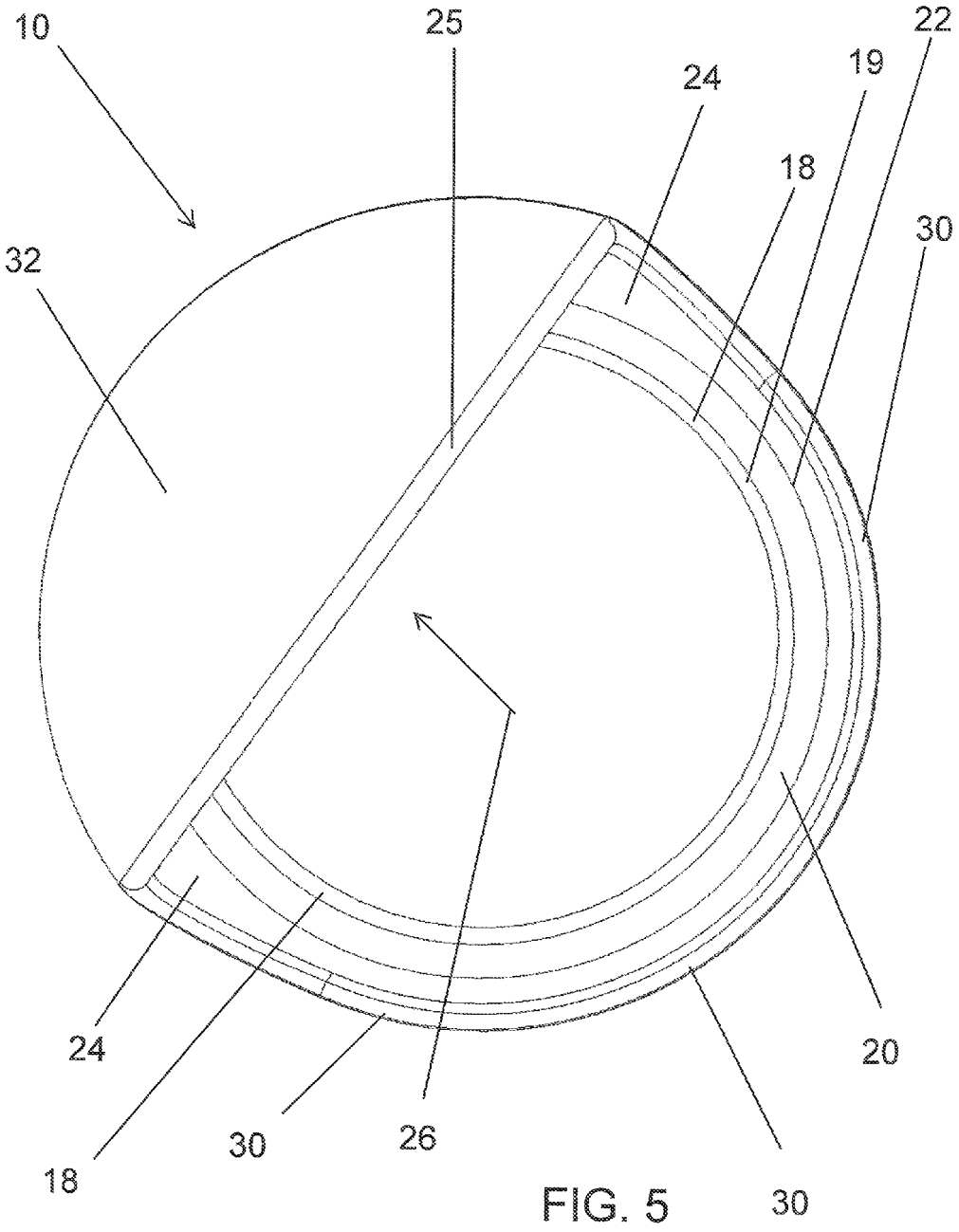
FIG. 5 is a top view of the ball retrieving receptacle shown in FIGS. 1-4.

FIG. 5 is a top view of the ball retrieving receptacle 10. Illustrated are the top 25 and back 32 of the hood 24, the top 22 of the sloping collar 18, and the top 19 of the sleeve 18. Also shown is the semisphere rim 30 and the bottom 17 of the tubular sleeve 18.

Figure 6:
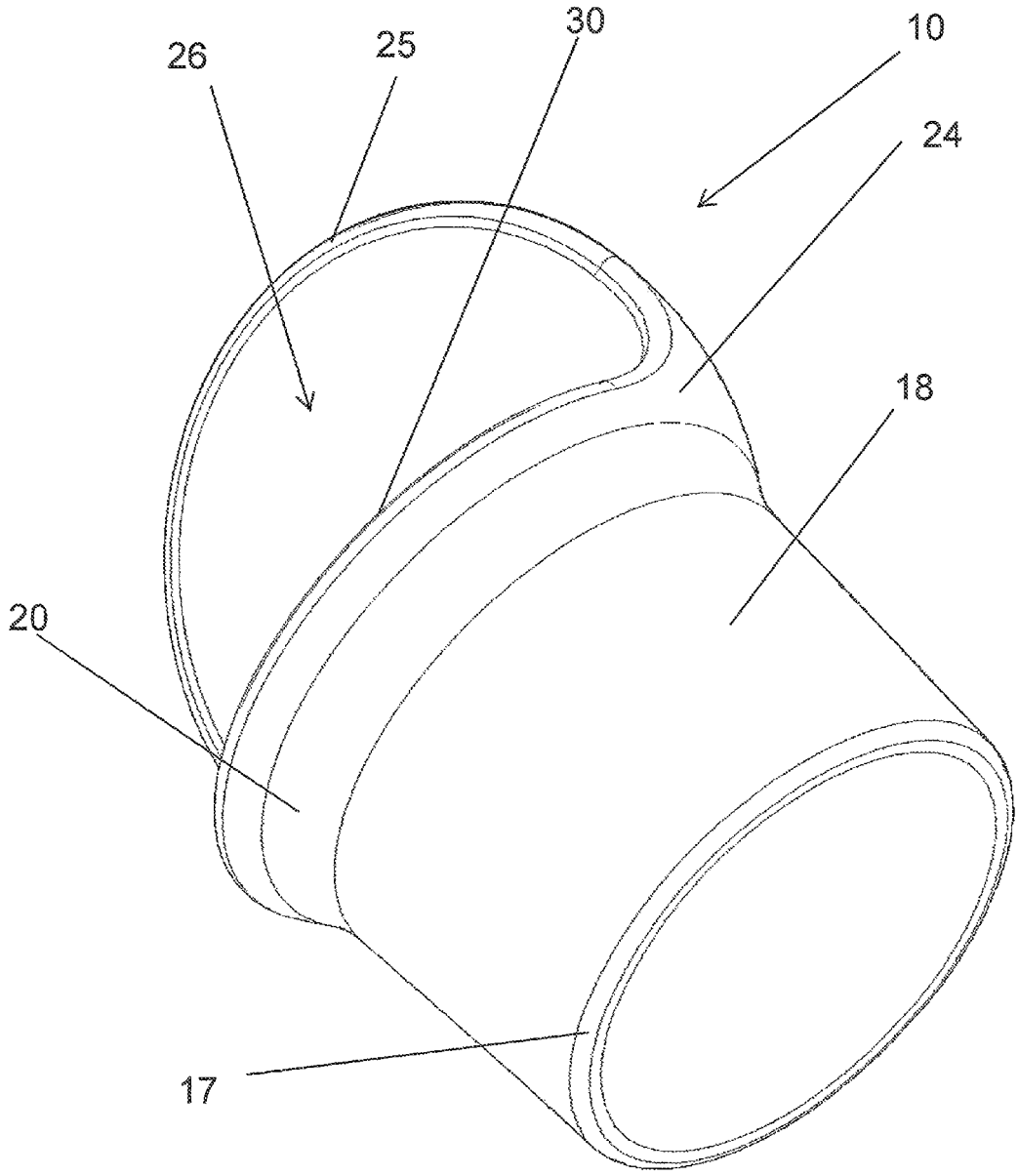
FIG. 6 is a perspective view of the ball retrieving receptacle shown in FIGS. 1-5 from a different angle.

FIG. 6 is a perspective view of the ball retrieving receptacle 10 from a different angle. Illustrated are the bottom opening 17 of the tubular sleeve 18, the sloping collar 20, and the hood 24. Further illustrated are top 25 and opening 26 of the hood 24.

Figure 7:
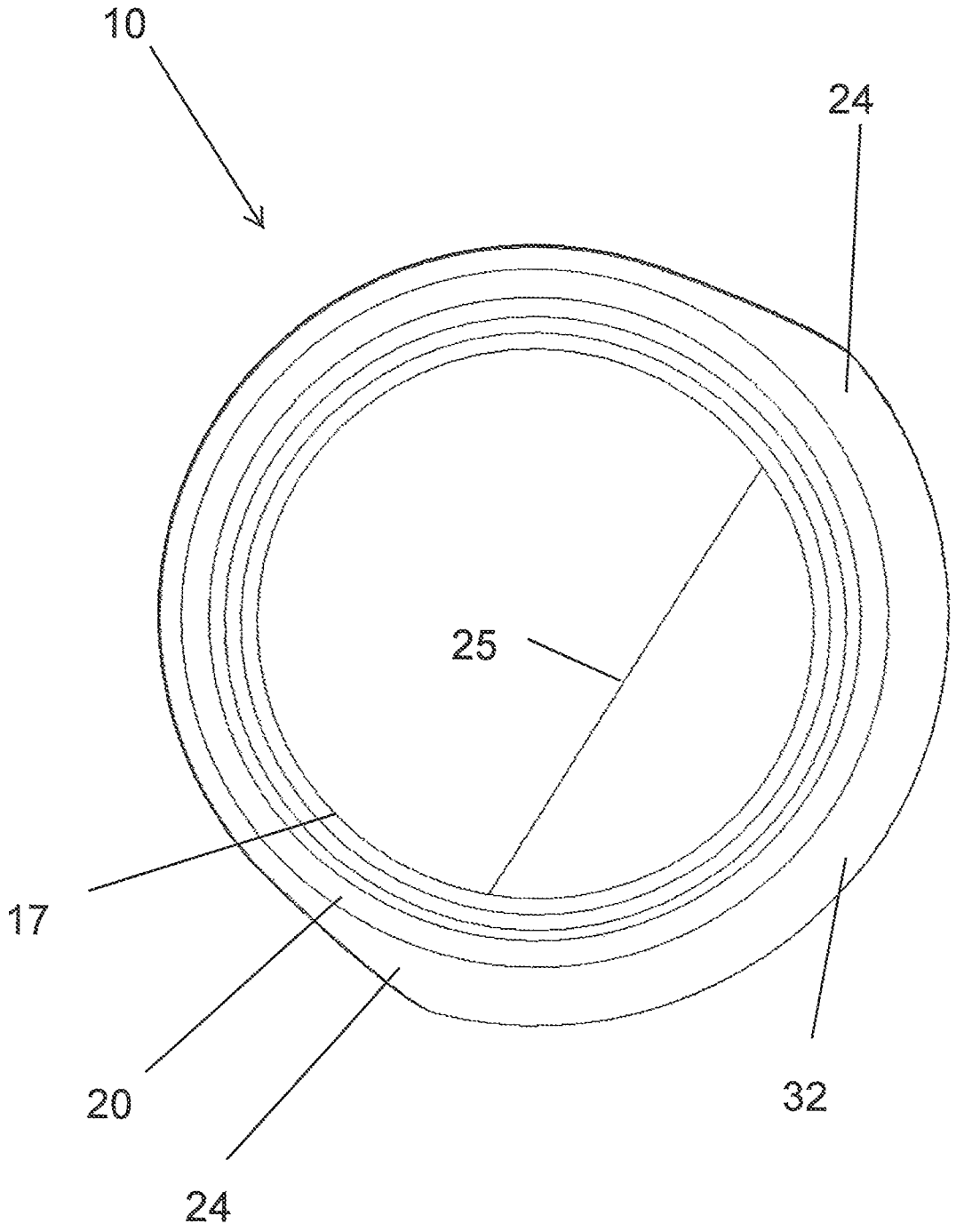
FIG. 7 is a bottom view of the ball retrieving receptacle shown in FIGS. 1-6.

FIG. 7 is a bottom view of the ball retrieving receptacle 10. Shown are the bottom opening 17 of the sleeve 18, the sloping collar 20, and the hood 24. Also illustrated are the top 25 and back 32 of the hood 24.

Figure 8:
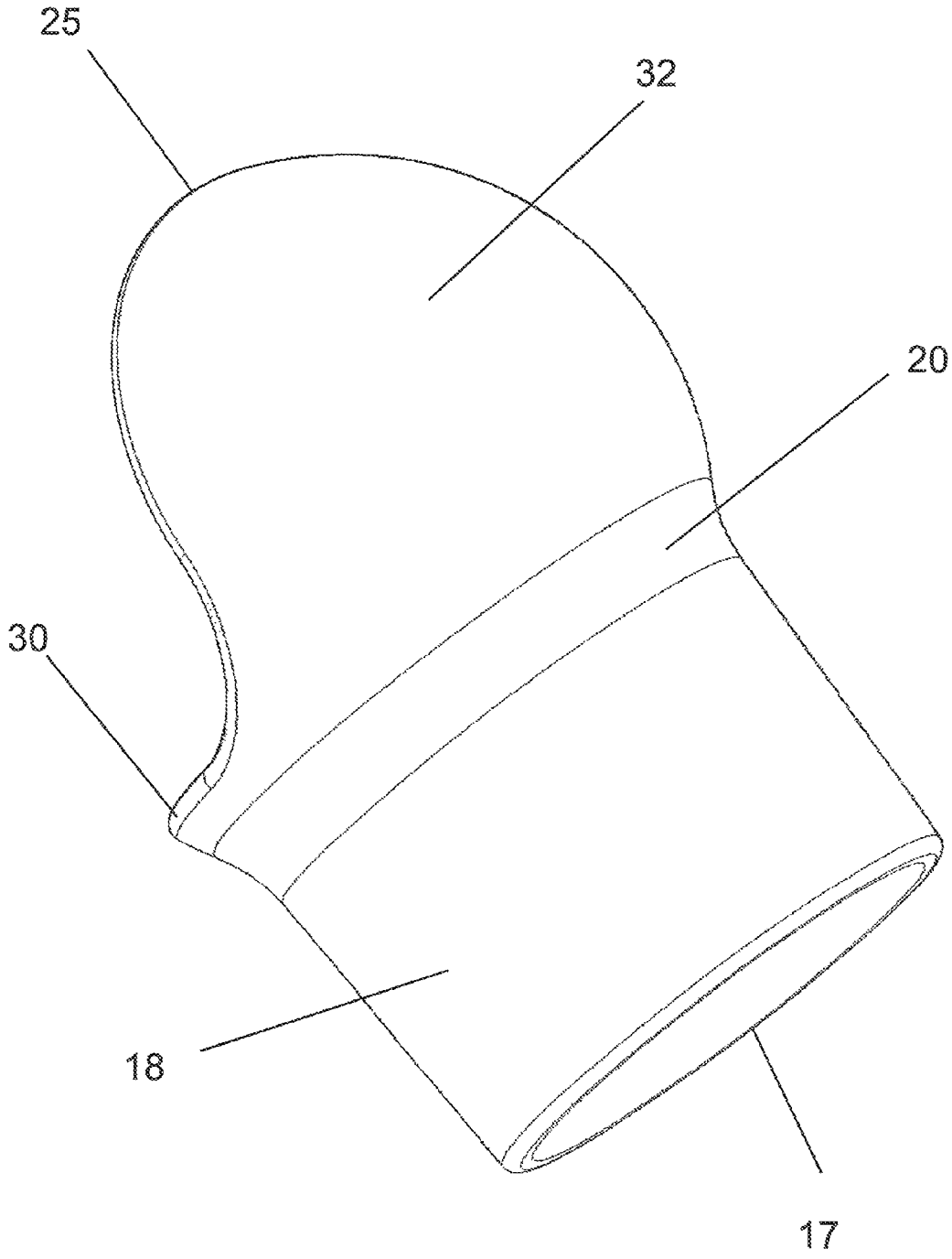
FIG. 8 is a perspective view of the ball retrieving receptacle shown in FIGS. 1-7 from a different angle.

FIG. 8 is a perspective view of the rear of the ball retrieving receptacle 10. Illustrated are the top 25 and rear 32 of the hood 24. Also illustrated are the bottom opening 17 of the sleeve 18. The sloping collar 20 and the semisphere 30 of the hood 24 is further illustrated.

The ball retrieving receptacle 10 preferably is attached to the bat 12, such as a baseball or softball bat, by first inserting the handle end 13 into the opening 26 of the hood 24, and then passing the handle end 13 through the sleeve 18 and out the bottom opening 17. The ball retrieving receptacle 10 is then passed along the bat 12 all the way up to the ball-striking area 16 of the bat 12. Since the diameter of conventional bats are greatest at the ball-striking end 15, the diameter of the sleeve 18, which is sized to be slightly less than the ball-striking end 15, prevents the sleeve 18 from coming off the ball-striking end 15. The sleeve 18 can be sized and molded for different sized bats.

Figure 9A:
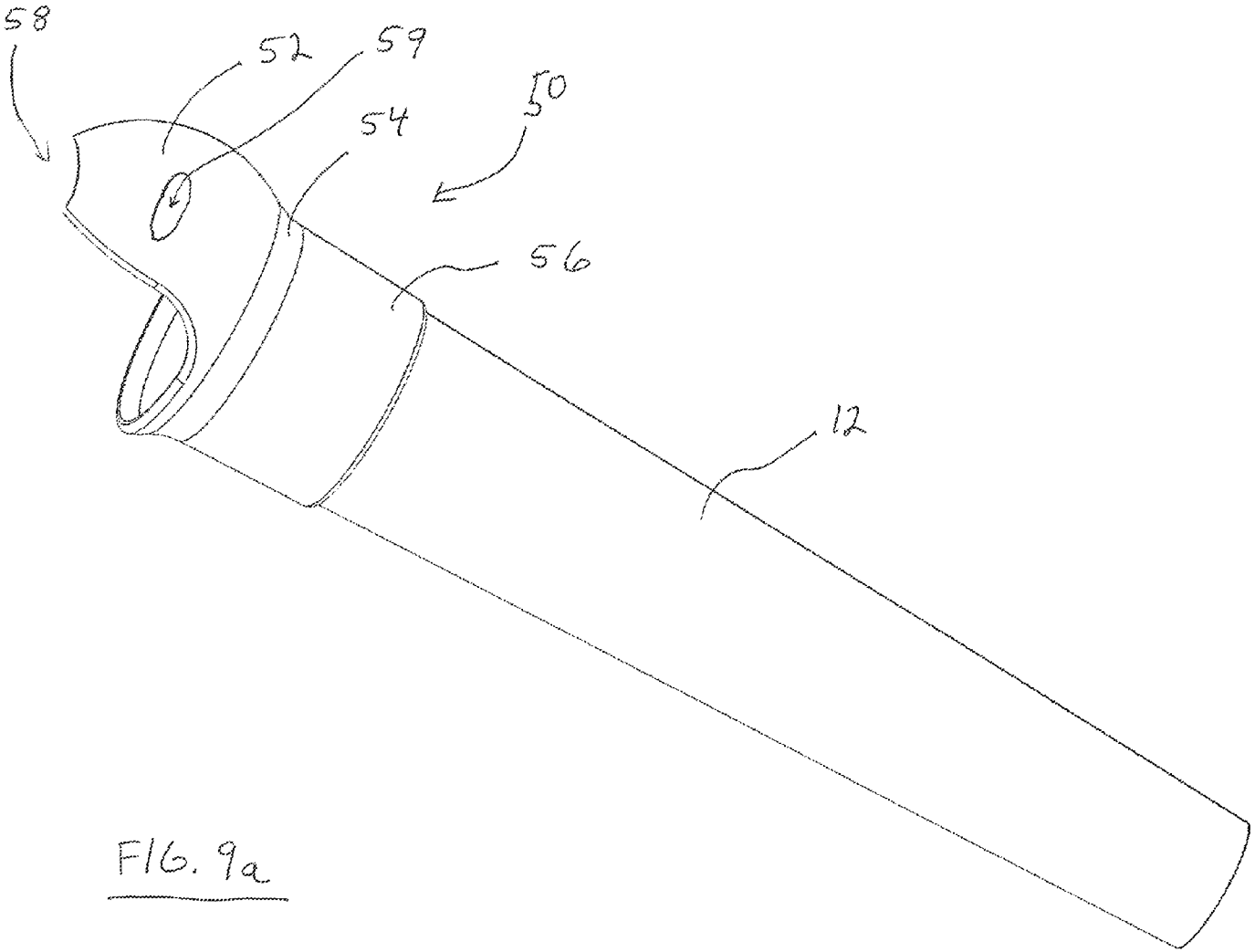
FIG. 9*a* is a perspective view of a ball retrieving receptacle configured in accordance with a further embodiment of the present invention.
Figure 9B:
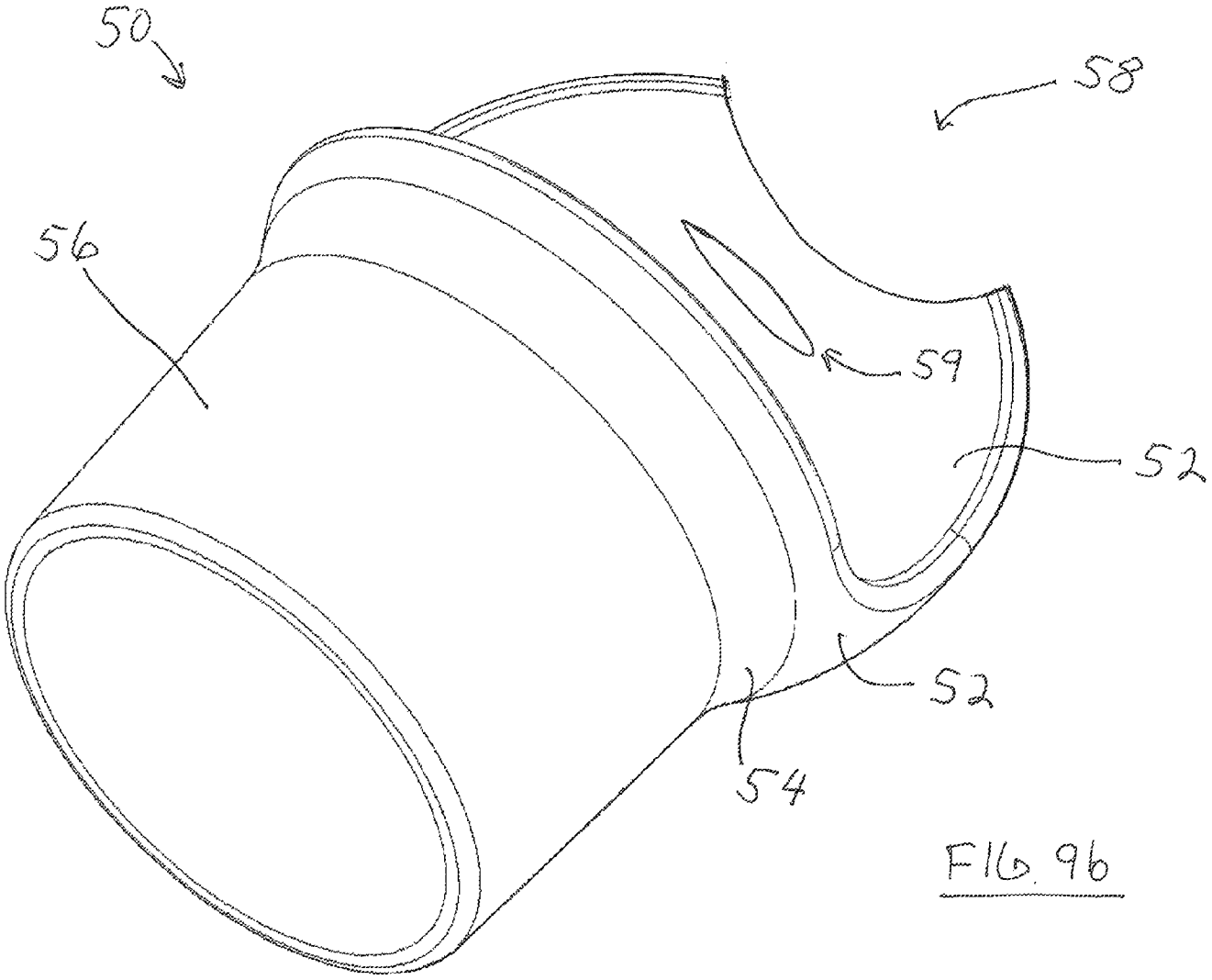
FIG. 9*b* is a perspective view of the ball retrieving receptacle shown in FIG. 9*a;*
Figure 9C:
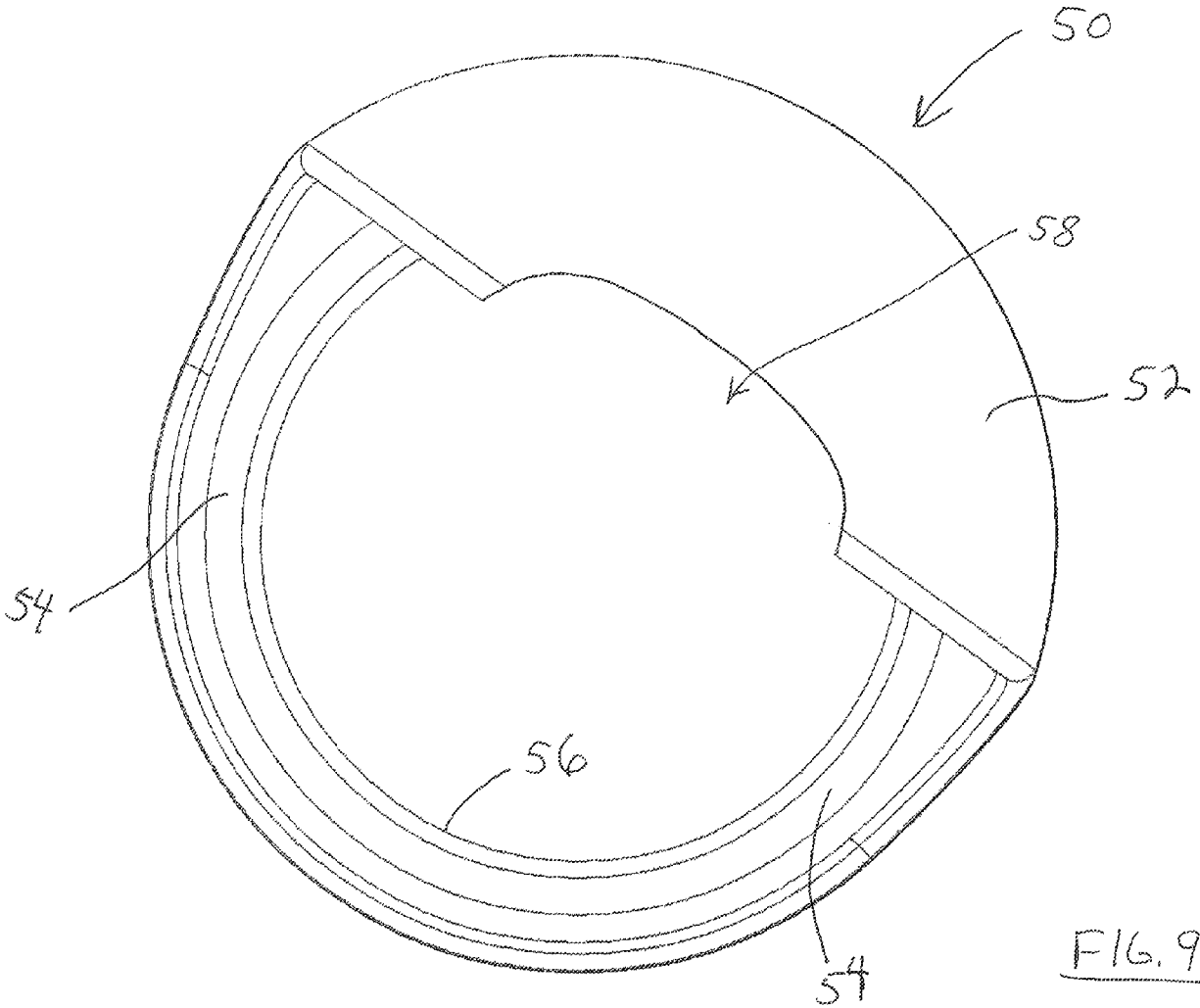
FIG. 9*c* is a perspective view of the ball retrieving receptacle shown in FIGS. 9*a* and 9*b*.

FIG. 9*a* is a perspective view of a ball retrieving receptacle 50 configured in accordance with a further embodiment of the present invention. The receptacle 50 is attached to a conventional bat 12. The receptacle 50 is similar to receptacle 10, wherein receptacle 50 comprises a tubular sleeve 56, a sloping collar 54, and a semisphere hood 52. In contrast to the receptacle 10, the receptacle 50 includes a cutout 58 on the top of the semisphere hood 52, and an aperture 59 in the back of the semisphere hood 59. The cutout 58 enables the receptacle 50 to pass over the handle of a bat more easily when sliding onto a bat to be installed. Similarly, the aperture 59 enables the semisphere 52 to be more flexible when the receptacle 50 is bent or flexed to slide over the handle of a bat. FIG. 9*b* is a perspective view of the receptacle 50 shown in FIG. 9*a* from a different angle and removed from the bat 12. The cutout 58 and the aperture 59 in the semisphere hood 52 are clearly visible. FIG. 9*c* is a top view of the receptacle 50 shown is FIGS. 9*a* and 9*b*. The cutout 58 is shown in the semisphere 52 of the receptacle 50.

Figure 10:
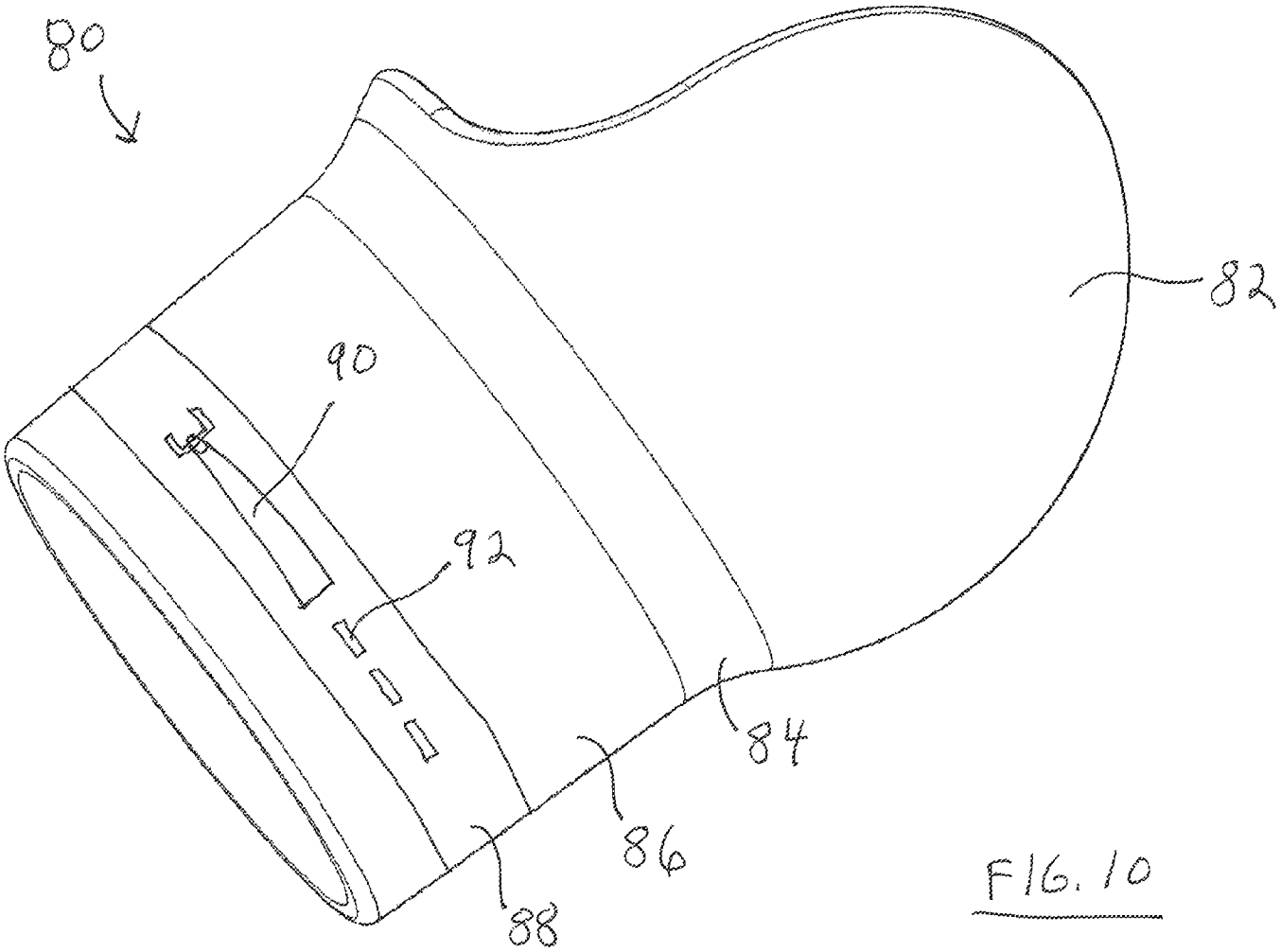
FIG. 10 is a perspective view of a ball retrieving receptacle configured in accordance with a further embodiment of the present.

FIG. 10 is a perspective view of a ball retrieving receptacle 80 configured in accordance with another embodiment of the present invention. The ball retrieving receptacle 80 includes a tubular sleeve 86, a sloping collar 84, and a semisphere 82. The ball retrieving receptacle 80 is similar to the ball retrieving receptacle 10, except the ball retrieving receptacle 80 further comprising a strap 88 with a belt buckle 90 for tightening the strap 88 around the tubular sleeve 86, so as to tighten the tubular sleeve 86 around a bat 12. The strap 88 includes apertures or slots 92 for receiving or locking the belt buckle 90 at different settings so as to tighten the tubular sleeve 86 around different bats having different diameters. In this embodiment, the tubular sleeve 86 preferably is constructed of a flexible material so as to accommodate different size bats having different diameters.

While specific embodiments have been shown and described to point out fundamental and novel features of the invention as applied to the preferred embodiments, it will be understood that various omissions and substitutions and changes of the form and details of the invention illustrated and in the operation may be done by those skilled in the art, without departing from the spirit of the invention.

The invention claimed is:

1. A receptacle for retrieving a ball that attaches to a bat, comprising:

a tubular sleeve having a diameter sized to fit tightly around an end of a ball-striking surface of a bat, the tubular sleeve having a top opening and a bottom opening, and a circular wall extending in between, wherein the top opening has a greater diameter than the bottom opening, and the diameter of the circular wall decreases as the circular wall extends from the top opening to the bottom opening;

a sloping collar having a bottom connected to the top opening of the tubular sleeve, wherein the diameter of the sloping collar increases as the sloping collar extends away from the top opening of the tubular sleeve toward an outer rim of the sloping collar; and a semisphere hood connected to the outer rim of the sloping collar, the semisphere hood including a semicircle rim extending in front of an opening of the semisphere hood and connected to the outer rim of the sloping collar.

2. The receptacle of claim 1, further comprising:

a bat having a handle and a ball-striking surface, wherein ball-striking surface of the bat is located within the tubular sleeve of the receptacle.

3. The receptacle of claim 1, wherein the receptacle is constructed is a single, unitary material.

4. The receptacle of claim 1, wherein the receptacle is constructed of a rigid material.

5. The receptacle of claim 1, wherein the receptacle is constructed of plastic.

6. The receptacle of claim 1, further comprising:

a fastener for tightening the tubular sleeve around a ball-striking surface of a bat.

7. The receptacle of claim 6, wherein the fastener is an adjustable buckle.

8. The receptacle of claim 1, wherein a top of the semisphere hood includes a cutout.

9. The receptacle of claim 1, wherein an aperture is located in a back wall of the semisphere hood.

10. The receptacle of claim 2, wherein the bat is a baseball bat.

11. The receptacle of claim 1, wherein the tubular sleeve is constructed of flexible material.

12. The receptacle of claim 1, further comprising:

a bat having a handle and a ball-striking surface, wherein ball-striking surface of the bat is located tightly against the tubular sleeve of the receptacle.

13. The receptacle of claim 2, wherein the bat is a plastic wiffle bat.

14. A receptacle for retrieving a ball that attaches to a bat, comprising:

a tubular sleeve having a diameter sized to fit tightly around an end of a ball-striking surface of a bat, the tubular sleeve having a top end and a bottom opening, and a circular wall extending in between;

a sloping collar having a bottom connected to the top end of the tubular sleeve, wherein the diameter of the sloping collar increases as the sloping collar extends away from the top end toward an outer rim of the sloping collar; and a semisphere hood connected to the outer rim of the sloping collar, the semisphere hood including a semicircle rim extending in front of an opening of the semisphere hood and connected to the outer rim of the sloping collar.

15. The receptacle of claim 14, wherein the top end of the tubular sleeve has a greater diameter than the bottom opening, and the diameter of the circular wall decreases as the circular wall extends from the top end to the bottom opening.

16. The receptacle of claim 14, wherein an opening is located in the top end of the tubular sleeve.

17. The receptacle of claim 14, further comprising:

a bat having a handle and a ball-striking surface, wherein the ball-striking surface of the bat is located tightly against the tubular sleeve of the receptacle.

18. The receptacle of claim 17, wherein the tubular sleeve is located at an end of the ball striking surface, opposite an end of the handle.

* * * * *